US005917418A

United States Patent [19]

Han

[11] Patent Number: 5,917,418

[45] Date of Patent: Jun. 29, 1999

[54] SYSTEM FOR CONFIRMING THE POSITION OF AN OIL JET

[75] Inventor: Byung-Hyuk Han, Ulsan-shi, Rep. of Korea

[73] Assignee: Hyundai Motor Company, Seoul, Rep. of Korea

[21] Appl. No.: 08/949,982

[22] Filed: Oct. 14, 1997

[30] Foreign Application Priority Data

Oct. 16, 1996 [KR] Rep. of Korea ..... 96-46231

[51] Int. Cl.[6] ..... G08B 21/00

[52] U.S. Cl. ..... 340/686.2; 340/439; 340/686.4; 340/691.7; 340/693.5; 123/41.35; 123/41.42

[58] Field of Search ..... 340/438, 439, 340/449, 450.3, 540, 679, 686.1, 686.2 OR, 691.1, 691.6, 691.7, 693.5, 686.4; 123/41.35, 41.42

[56] References Cited

U.S. PATENT DOCUMENTS 4,011,797 3/1977 Cornet ..... 123/41.35
4,995,346 2/1991 Hudson, Jr. ..... 123/41.35
5,175,532 12/1992 Wojciechowski et al. ..... 340/686.4
5,533,472 7/1996 Sands et al. ..... 123/41.35

*Primary Examiner*—Daniel J. Wu
*Attorney, Agent, or Firm*—Christie, Parker & Hale, LLP

[57] ABSTRACT

The present invention relates to a system for confirming the position of an oil jet in diesel engines. The system includes a mounting means with a hole formed at the bottom end for receiving the nozzle end portion of the oil jet. At the top end of the mounting means is a light emitting element positioned in front of the center of the nozzle end of the oil jet. The light emitting element is connected to a power supply. A light projecting means is inserted in the mounting means in front of the light emitting element. The light projecting means projects the collected light from the light emitting element in a straight line. A light receiving element is mounted in an oil hole of a piston, and receives the light projected from the light projecting means. The light receiving element actuates an alert means when it detects light from the light projecting means to allow confirmation of proper oil jet alignment, thereby improving the piston lubrication and engine cooling.

14 Claims, 3 Drawing Sheets

SYSTEM FOR CONFIRMING THE POSITION OF AN OIL JET

BACKGROUND OF THE INVENTION

The present invention relates to a system for confirming the position of an oil jet in a diesel engine, and more particularly, to a system for confirming the position of an oil jet for improving oil injection into an oil hole of a piston.

In general, a diesel engine, as shown in FIG. 3, includes an oil jet 20 mounted to a cylinder block 10. The oil jet 20 injects oil from a main gallery to a piston 30.

Because a diesel engine is a high performance engine, similar to gasoline engines, the pistons become easily overheated. In order to cool the cylinder, an oil jet 20 is mounted to the cylinder block 10 near the bottom portion. The oil jet has a nozzle 21 which directs the oil into an oil hole of the piston 30.

That is, the oil from the main gallery of the cylinder block 10, which is at a predetermined pressure, is injected into the oil hole of the piston 30 through the nozzle 21, so that the piston in the cylinder can be cooled.

However, the conventional oil jet 20, once mounted to the engine, provides no way to confirm whether or not the oil is injected into the oil hole of the piston 30.

Accordingly, when the oil jet is misaligned with the oil hole of the piston, the lubrication of the piston and the cooling of the engine suffers causing piston wear and engine overheating.

SUMMARY OF THE INVENTION

An embodiment of the present invention is directed to a system which overcomes these problems. It is, therefore, an object of the present invention to provide a means for easily confirming the position of the oil jet when mounted to the engine.

It is another object of the present invention to provide oil injection into the oil hole of the piston to provide improved cooling of the engine and lubrication of the piston.

In order to attain the above objects, an embodiment of the present invention includes a mounting means for mounting to the nozzle end portion of the oil jet. A light emitting element is positioned in the mounting means in front of the center of the nozzle end of the oil jet. The light emitting element is connected to a power supply. A light projecting means is positioned in the mounting means immediately in front of the light emitting element, and projects the light collected from the light emitting element in a straight line. A light receiving element is mounted in the oil hole of a piston, and actuates an alert means in response to light from the light projecting means.

DETAILED DESCRIPTION OF THE INVENTION

Hereinafter, a preferred embodiment of the present invention will be described more in detail with reference to the accompanying drawings.

Figure 1:
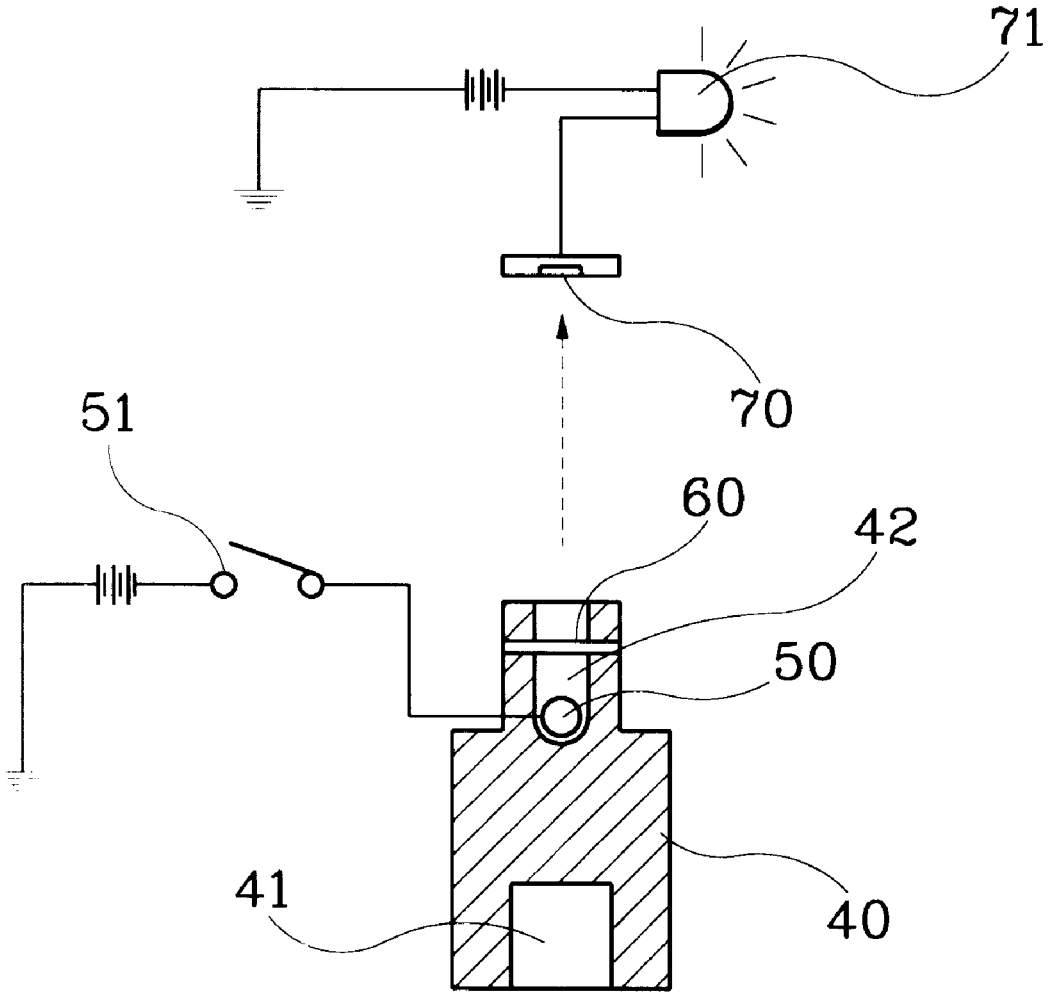
FIG. 1 is a schematic diagram showing an embodiment in accordance with the present invention.

FIG. 1 is a schematic diagram showing a cross-sectional view of an embodiment of the present invention. The system includes a mounting means 40, a light emitting element 50, a light projecting means 60, and a light receiving element 70.

The mounting means 40 is defined with an inserting hole 41 at one end for receiving the nozzle end portion 21 of an oil jet 20. A light projecting hole 42 is formed at the opposite end of the mounting means 40 and holds the light emitting element 50 in front of the center of the nozzle end portion 21 of the oil jet 20. The light emitting element 50 is supplied with a predetermined voltage by a switch means 51. The light projecting means 60, mounted in front of the light emitting element, projects the light collected from the light emitting element 50 in a straight line.

The light receiving element 70 is mounted in the oil hole of the piston 30 and receives the light projected from the light projecting means 60. The light receiving element actuates an alert means 71, such as a buzzer or lamp, when it detects light from the light projecting means 60.

Figure 2:
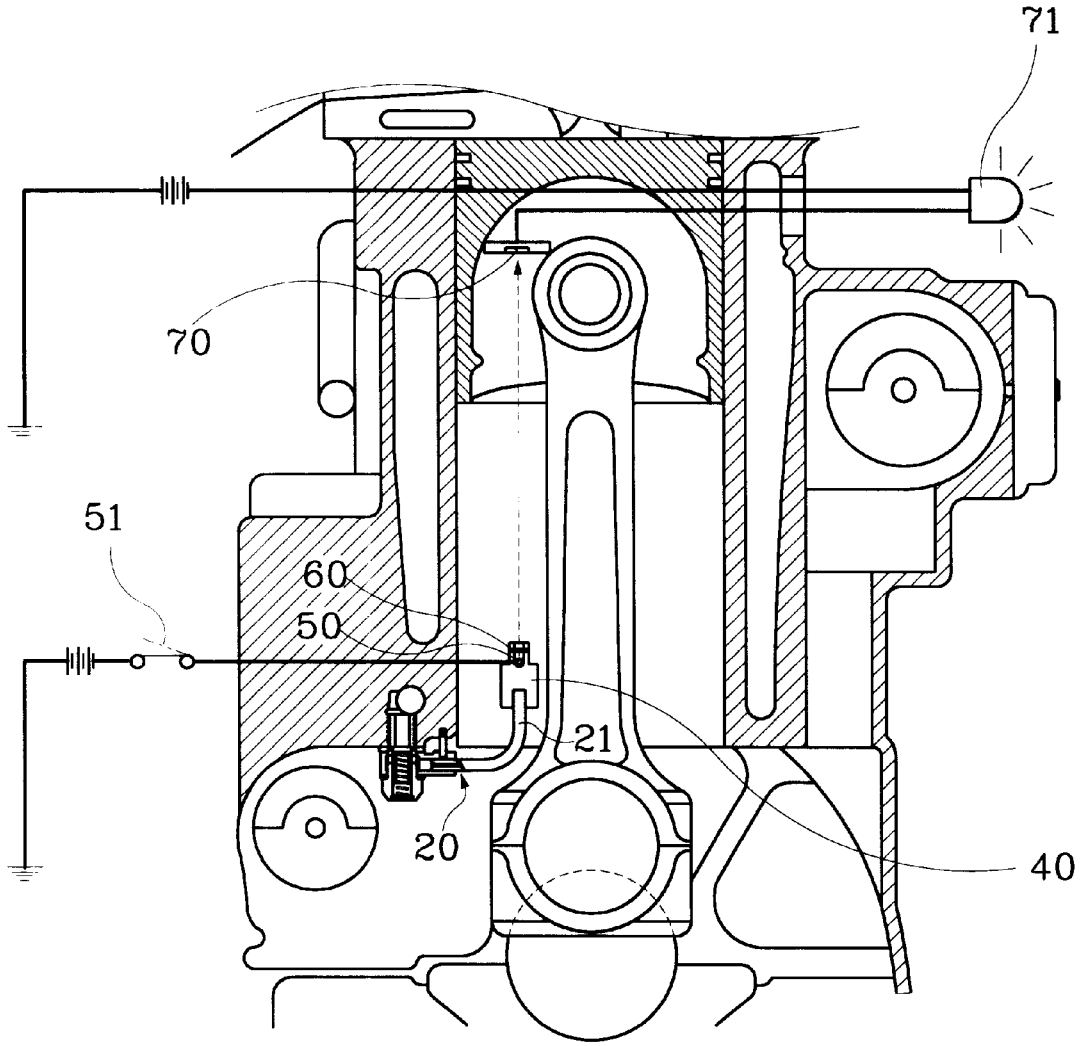
FIG. 2 is a cross-sectional view showing the operation of an embodiment in accordance with the present invention.
Figure 3:
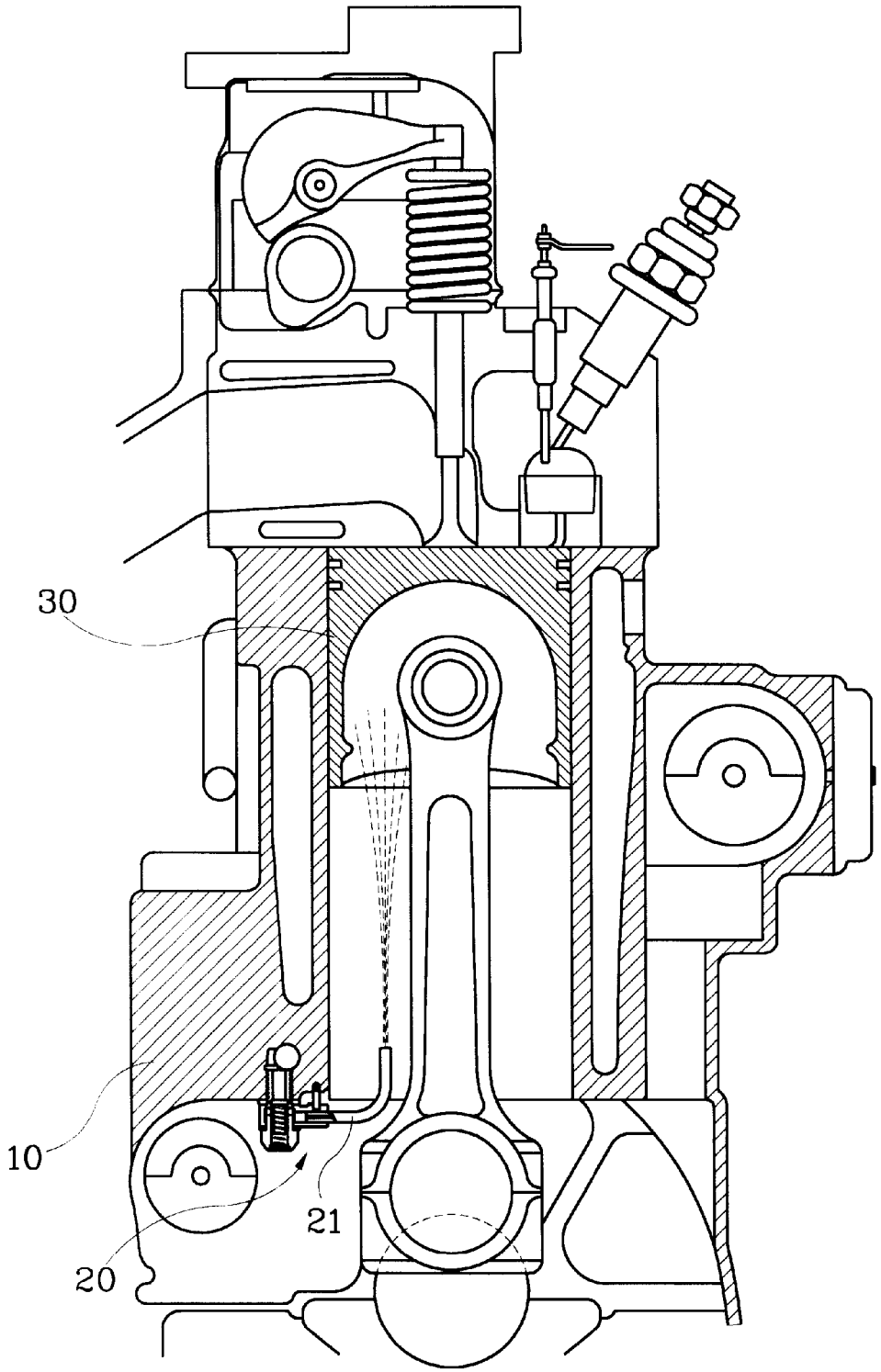
Fig. 3 (Prior Art)
FIG. 3 is a side and partly cross-sectional view showing conventional lubrication.

The described embodiment results in a system capable of confirming whether or not the oil is injected into the oil hole of the piston by the oil jet 20, as in FIG. 2, when assembled to the engine.

Accordingly, when the oil jet 20 is assembled to the engine and the mounting means 40 is mounted on the nozzle end 21 of the oil jet 20, via the inserting hole 41, and the light receiving element 70 is mounted in the oil hole of the piston 30, the alignment of the oil jet 20 can be confirmed by a light sensing reaction.

That is, oil jet 20 alignment can be performed by applying a voltage to the light emitting element 50 by closing the switch means 51. This causes the light emitting element 50 to emit light which is projected through the projecting hole 42 via the light projecting means 60.

The projected light actuates the alert means 71 connected to the light receiving element 70. Conversely, the alert means 71 in not actuated when the light receiving element 70 does not detect light.

This approach allows confirmation of whether or not the oil jet 20 is aligned with the oil hole of the piston 30. That is, when the alert means 71 is actuated, the oil jet 20 is properly aligned with the oil hole of the piston 30, and conversely, when the alert means 71 is not actuated, the oil jet 20 is not properly aligned, and therefore, requires further alignment before completing assembly of the engine.

Since the confirming process allows visual confirmation on whether or not the oil jet 20 is aligned with the piston 30, more precise mounting of the oil jet 20 can be achieved.

Accordingly, heretofore the oil jet 20 was not always properly aligned causing piston wear and engine overheating. The system for confirming the position of the oil jet in accordance with a preferred embodiment of the present invention allows greater accuracy in aligning the oil jet during assembly to ensure proper oil flow to the piston.

Therefore, with increased alignment capability of the oil jet 20 during assembly of the engine, piston lubrication and engine cooling is improved which improves the reliability of the engine.

What is claimed is:

1. A system for confirming the nozzle end position of an oil jet relative to an oil hole of a piston in an engine, comprising:

a light emitting element and a mount for mounting the light emitting element on the nozzle end of the oil jet;

a light receiving element adapted to be positioned in such an oil hole of the piston; and an indicator actuated when light emitted from the light emitting element is received by the light receiving element.

2. The system of claim 1 wherein the mount is adapted for positioning the light emitting element in front of the nozzle end of the oil jet.

3. The system of claim 2 wherein said mount comprises a first end having a first aperture for mounting the light emitting element therein, and a second end having a second aperture for receiving the nozzle end of the oil jet.

4. The system of claim 3 in combination with an engine comprising the nozzle end of the oil jet and the oil hole in the piston.

5. The system of claim 2 further comprising light projecting means, disposed between the light emitting element and the light receiving element, for collecting the light from the light emitting element and projecting said light in a substantially straight line toward the light receiving element.

6. The system of claim 5 wherein said light projecting means is positioned in the second aperture of the mount.

7. A method for confirming the position of the nozzle end of an oil jet relative to an oil hole in a piston of an engine, comprising the steps of:

positioning a light emitting element in front of, and adjacent to, the nozzle end of the oil jet;

positioning a light receiving element in the oil hole of the piston; and actuating an indicator when light emitted from the light emitting element is received by the light receiving element.

8. The method of claim 7 further comprising the steps of adjusting the nozzle end of the oil jet together with the light emitting element to a position so as to actuate the indicator, and mounting the nozzle end of the oil jet in the engine at said position.

9. A method for confirming a jetting position of the nozzle end of an oil jet relative to an oil hole in a piston of an engine, comprising the steps of:

positioning a mounting device on the nozzle end of the oil jet;

emitting light from a light emitting element positioned in front of, and along a center of, the nozzle end;

mounting a light projecting means on the mounting device in front of the light emitting element, and collecting the light emitted from the light emitting element to direct the light in a substantially straight line;

mounting a light receiving element in the oil hole of the piston, and receiving the light emitted from the light emitting element with the light receiving element; and indicating when the light is received by the light receiving element.

10. A system for confirming the position of an oil jet in an engine, said oil jet having a nozzle end portion, and said engine having a piston with an oil hole comprising:

mounting means for mounting on such nozzle end portion of the oil jet;

a light emitting element for positioning in the mounting means in front of the nozzle end portion of the oil jet, said light emitting element emitting light when connected to a power supply;

light projecting means, for positioning in the mounting means in front of the light emitting element, for collecting the light emitted from the light emitting element and projecting said light in a substantially straight line in a direction away from the nozzle end of the oil jet;

a light receiving element for mounting in such oil hole of the piston; and alert means, connected to the light receiving element, for indicating when the light receiving element receives light from the light protecting means.

11. The system of claim 1 further comprising a switch for selectively connecting such power supply to said light emitting element.

12. The system of claim 1 wherein said alert means comprises a buzzer.

13. The system of claim 1 wherein said alert means comprises an electric lamp.

14. The system of claim 10 in combination with such an engine comprising such nozzle end portion of an oil jet and such an oil hole in a piston.

* * * * *